United States Patent [19]

Chevrolet et al.

[11] 3,999,003

[45] Dec. 21, 1976

[54] TELECOMMUNICATION CABLE RESISTANT TO WATER PENETRATION

[75] Inventors: Gerard Chevrolet, Grand-Lancy, Geneva, Switzerland; Claude Guignard, Ferney-Voltaire, France; Maurice Poull, Meyrin, Geneva, Switzerland

[73] Assignees: Sa des Cableries et Trefileries de Cossonay a Swiss corporation, Cossonay-Gare; Kabelwerke Brugg A. G., a Swiss Corporation, Brugg; Societe d'Exploitation des Cables Electriques Systeme Berthoud Borel & Cie, a Swiss Corporation, Cortaillod, all of Switzerland; part interest to each

[22] Filed: Nov. 26, 1975

[21] Appl. No.: 635,639

Related U.S. Application Data

[63] Continuation-in-part of Ser. No. 388,589, Aug. 15, 1973, abandoned.

[30] Foreign Application Priority Data

Aug. 18, 1972 Switzerland ..... 12254/72

[52] U.S. Cl. ..... 174/23 R; 174/27; 174/113 AS; 174/111; 174/116

[51] Int. Cl.[2] ..... H01B 11/02

[58] Field of Search ..... 174/23 R, 27, 113 R, 174/113 AS, 111, 116, 121 R; 427/206

[56] References Cited

UNITED STATES PATENTS

| | | | |
|---|---|---|---|
| 2,118,907 | 5/1938 | Unterbusch | 174/116 |
| 2,187,391 | 1/1940 | Borgeson | 174/121 R |
| 2,348,752 | 5/1944 | Quayle | 174/27 |
| 2,675,420 | 4/1954 | Yeager | 174/121 R |

FOREIGN PATENTS OR APPLICATIONS

| | | | |
|---|---|---|---|
| 20,505 | 3/1969 | Japan | 427/206 |

*Primary Examiner*—E. A. Goldberg
*Attorney, Agent, or Firm*—Karl F. Ross; Herbert Dubno

[57] ABSTRACT

A cable for telephone or other communication circuits comprises a number of conductor arrays, specifically pairs or quads of helically intertwined conductors, each conductor having a metal core coated with a thermoplastic sheath in which a multiplicity of short cellulose fibers are embedded; the fibers have an average length of about 1 mm and project generally radially from the sheath over the greater part of their length. The fibers of the twisted wires interpenetrate and form a mat in the intervening spaces which swells in the event of water penetration through a defective envelope, thereby limiting the propagation of moisture along the cable.

9 Claims, 9 Drawing Figures

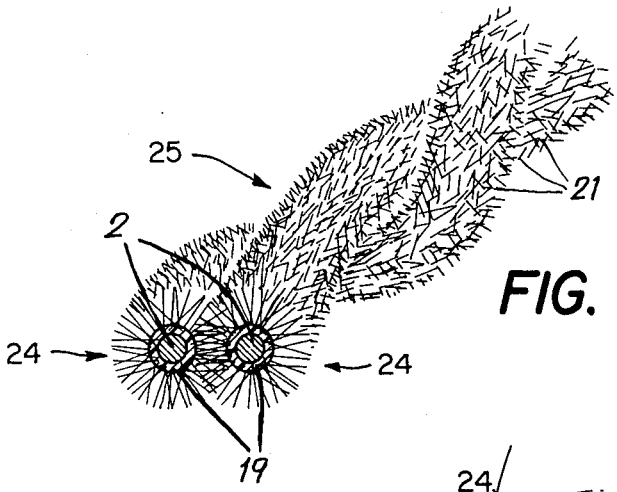
FIG. 5
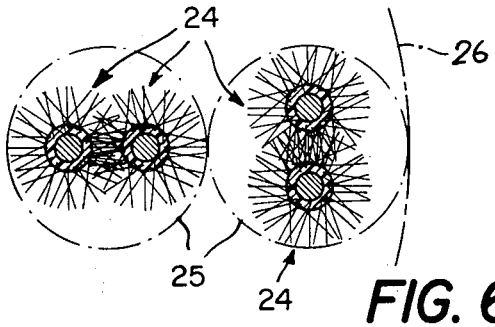
FIG. 6
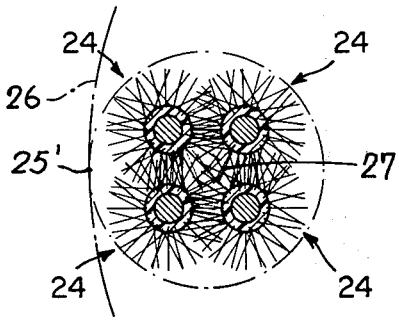
FIG. 7
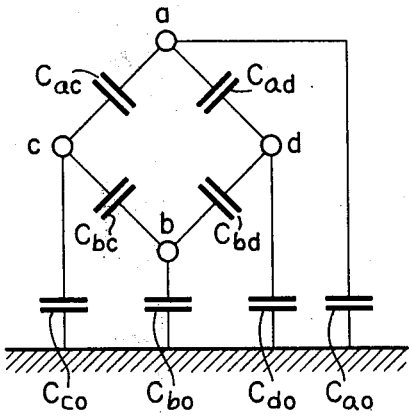
FIG. 8
FIG. 9
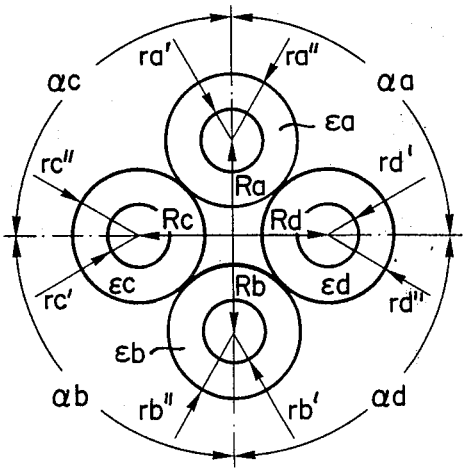

TELECOMMUNICATION CABLE RESISTANT TO WATER PENETRATION

CROSS-REFERENCE TO RELATED APPLICATION

This application is a continuation-in-part of our copending application Ser. No. 388,589 filed 15 Aug. 1973 and now abandoned.

FIELD OF THE INVENTION

Our present invention relates to the insulation of electrical wires and more particularly to insulated conductors of cables for the transmission of voice and other signals in telecommunication systems.

BACKGROUND OF THE INVENTION

Conventional telecommunication cables other than those of the coaxial type comprise, within a common flexible envelope, a multiplicity of conductor arrays each consisting of either two conductors (referred to as a balanced pair) or four conductors (referred to as a quad). The conductors of a pair are helically intertwined; two such pairs may be twisted together to form a quad of the kind known as DM (Dieselhorst-Martin) type. Arrays in which four conductors are twisted about a common axis are referred to as star quads. A quad may also consist of two pairs of twisted conductors extending alongside each other.

A quad thus comprises two conductor pairs each forming a signaling circuit which is balanced with reference to ground. A third signaling circuit, known as a phantom circuit, consists of the conductors of one pair connected in parallel for transmission in one sense and the conductors of the other pair connected in parallel for transmission in the opposite sense.

The close juxtaposition of the conductors within an array establishes distributed capacitances therebetween which, if not precisely balanced, give rise to spurious signals resulting in interference phenomena (i.e. cross-talk) among the several circuits. If the resistance of the wire insulation is low, leakage currents cause increased attenuation of the transmitted signals along the line.

The interconductor capacitances within a cable, whose imbalance is primarily responsible for the cross-talk, is determined not only by the dielectric constant of the insulating material but also by the geometry of the conductor array. Thus, any departure from geometrical symmetry among these conductors leads to a capacitive imbalance. That symmetry, however, is difficult to maintain with wires which are coated with thermoplastic sheaths extruded therearound, such extruded conductors being generally utilized nowadays in lieu of earlier constructions wherein the insulation consisted of paper strips helically wrapped around the wire. Drawbacks of these earlier insulations included their slow rate of production, their fragility and the difficulty of splicing them. The extruded conductors, on the other hand, have the disadvantage of relatively low friction which allows them to slide within the cable envelope during subsequent handling and impairs their original symmetry; also, the dielectric constant of the thermoplastic insulation is relatively high, thus requiring an increased sheath thickness to minimize the line attenuation due to leakage currents.

Moreover, quads of plastic-coated wires are ineffectual in resisting the propagation of moisture in the event of a rupture of the cable envelope. Usually, the entry of water onto the cable does not manifest itself in a significant immediate loss of signal strength and therefore often remains undetected until the water has permeated a considerable length of the cable and has wrought extensive damage. Attempts to limit the propagation of moisture inside a cable by gas pressure or viscous materials, such as petroleum jelly, are costly and cumbersome.

OBJECTS OF THE INVENTION

The general object of our present invention, therefore, is to provide an improved cable construction which obviates the aforestated disadvantages.

A more particular object is to provide a conductor array in such a cable which is geometrically stable so as to maintain its symmetry during assembly and installation, thereby reducing capacitive imbalances which would give rise to cross-talk.

Another more specific object is to provide an insulation for the conductors of such a cable which has an elevated resistance when dry, that resistance dropping sharply in the presence of moisture to signal the existence of a leak, and which effectively resists longitudinal penetration of the cable by such moisture.

SUMMARY OF THE INVENTION

We realize these objects, in accordance with our present invention, by constructing each of the cable conductors from a metallic core surrounded by a dielectric sheath and a multiplicity of nonconductive, preferably hydrophilic (notably cellulosic) fibers partly embedded in that sheath so as to extend generally radially therefrom, the fibers of adjacent conductors interpenetrating in an intervening space to maintain the relative position of the conductors within the array.

Such a conductor sheath can be produced by a flocking process, fully disclosed in our prior application identified above, wherein the fibers are electrostatically attracted into a molten plastic coating on the metallic core which is then allowed to harden around an end of each fiber whose generally radial position is maintained by the electrostatic field. The mean length of the fibers, which should be substantially uniform throughout the array, may be on the order of 1 millimeter, a major fraction (e.g. four fifths) of that length projecting from the thermoplastic sheath. Polyethylene, because of its low dielectric constant and high electrical resistance, is preferred as the thermoplastic material.

BRIEF DESCRIPTION OF THE DRAWING

The above and other features of our invention will now be described in detail with reference to the accompanying drawing in which:

FIG. 5 is a perspective view of a conductor pair forming part of a cable according to our invention;

FIG. 6 is a somewhat schematic cross-sectional view of a quad with two pairs of the type shown in FIG. 5;

FIG. 7 is a cross-sectional view of a star quad embodying our invention;

FIG. 8 is a circuit diagram serving to explain the relationship between cross-talk and intercircuit capacitances in a conventional quad; and FIG. 9 is a diagram showing other circuit parameters responsible for cross-talk and leakage currents.

SPECIFIC DESCRIPTION

Figure 1:
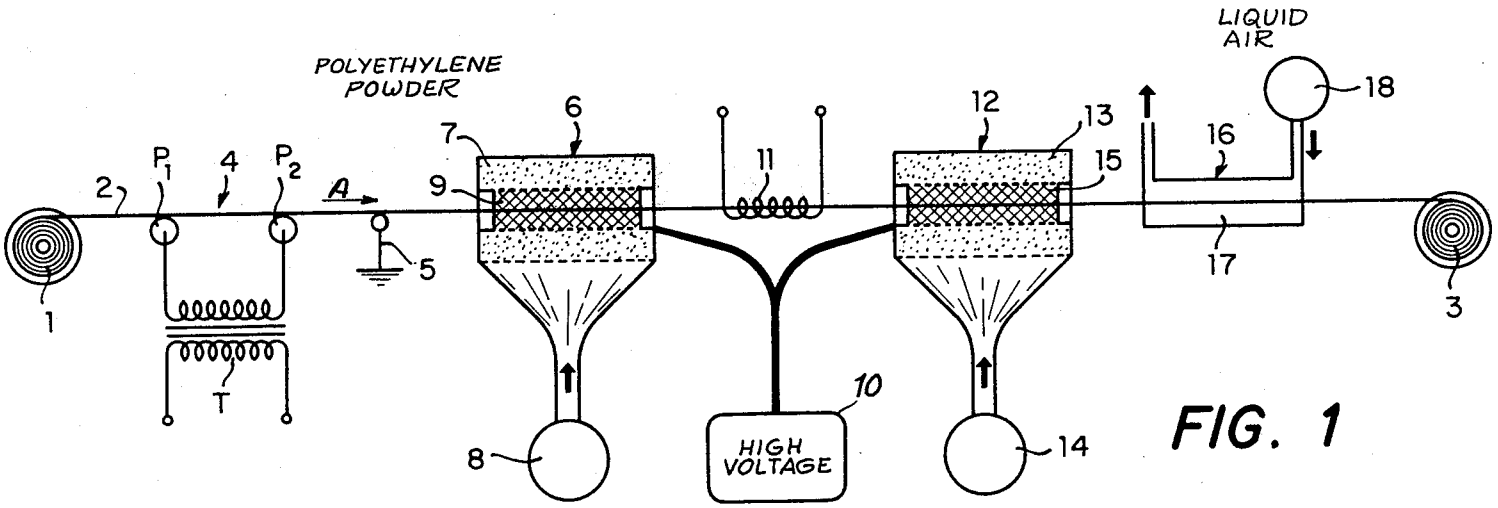
FIG. 1 is a schematic illustration of a plant for the coating of a wire to produce a conductor for a cable according to our invention.

The techniques about to be described with reference to FIGS. 1 – 4, known per se for other purposes, are designed to take advantage of the properties of electrostatic fields for the purpose of coating a metal wire, especially a copper wire, with an insulating substance whose physical and electrical properties conform to the objects of our invention.

The phenomena of electrostatics have been known for a very long time. Their practical exploitation, on the other hand, is relatively recent, though they are now being used at an increasing rate. In most cases, the technique is employed to control the movements of comparatively fine solid or liquid particles. Applications range from spinning, painting, powdering, flocking to the removal of dust and the like. The basic principle employed, however, is the same in all cases: an electrical charge placed in a field is subjected to a force oriented along the lines of force of such field and equal to the product of the charge multiplied by the field intensity:

$$f = q.E,$$

where $f$ = force exerted by the charged particle, $q$ = particle charge, $E$ = field intensity.

The field can be created by means of a potential difference between two electrodes. In the case of a homogeneous field generated between two flat electrodes, the field is given by the following formula $$E = (U/d)$$

where $U$ = voltage applied and $d$ = distance between the electrodes.

In air, the field intensity is limited to the breakdown voltage. This is of the order of 2 to 8 KV/cm and depends on the ionization of the medium, atmospheric conditions, and the number of particles present.

A particle can be charged in a number of ways, as by induction, ionization, contact or rubbing; several of these influences may combine simultaneously to contribute to the charge. Contact and rubbing are sufficiently well known and need no further explanation here. Charging by induction takes place when a conductor is placed within a field. It then receives the following maximum charge:

$$q = \sigma.F,$$

where $\sigma$ = charge density and $F$ = surface area of particle.

The density of the charge is given by $\sigma = \epsilon_o.E$ where $\epsilon_o$ = induction constant.

Depending on the conductivity of the particle, a longer or shorter time will be required to reach the maximum charge density. This value is referred to as the relaxation time:

$$\tau = \epsilon.\epsilon_o/K,$$

where $\epsilon$ = dielectric constant and $K$ = electrical conductivity.

Ionization charging mainly takes place in air when the charge electrode consists of wires or grids generating peak effects and very high local field intensities. The air is then intensely ionized and variously insulating particles are charged by a superficial layer of ions as they pass through the area.

Ladenburg's formula for the maximum charge acquired by a spherical particle of radius $r$ on passing through an ionized field is:

$$q = \frac{3\epsilon}{\epsilon+2} \pi \epsilon_o \cdot Er^2$$

A particle assumed to be spherical, therefore, when charged by ionization or induction, is subjected to a force $f = q.E$, whose value decreases with the square of its radius, while other mechanical stresses (weight, centrifugal force, etc.) decrease with its cube. In other words, the predominance of electrostatic forces is inversely proportional to the radius of the particle.

If other particles charged with the same sign are present, repulsion takes place in inverse proportion to the square of the distances between them (Coulomb's law). This leads to uniform distribution in space of the particles forming an electrical cloud, together with uniform deposition when they meet an electrode with an essentially constant field.

If a surface with a charge of opposite sign is encountered, the particles are attracted to it and stick to it to the extent that the charges are maintained. If the surface has the same electrical sign, on the other hand, they are repelled, or stripped off if they are already on such surface.

If a particle is longer in one direction, it will orient itself in the direction of the lines of force of the field and appear in a perpendicular position on the surface of an electrode.

In brief, therefore, electrostatic forces can entrain particles, conduct them to definite points, distribute them uniformly in space, strip them off or deposit them on a surface, and arrange them in a given direction.

The installation illustrated in FIG. 1 includes a number of components placed between a feed spool 1 holding a bare copper wire 2 and a take-up spool 3 receiving the insulated wire.

The first of these components, as viewed in the direction A followed by the wire on its passage from the feed spool 1 to the take-up spool 3, is a preheating device 4 for heating the bare wire 2 by means of the Joule effect. This device comprises two copper pulleys $P_1$, $P_2$ connected to the two secondary terminals of a transformer T; the wire is grounded via a conductor 5. After emerging from the preheating device, the wire passes into an electrostatic dusting device 6 comprising a powder holder 7 fed by compressed air from a source 8 which creates a flow of plastic powder within the holder 7. The dusting device houses a cylindrical electrode 9 that surrounds the wire 2, this electrode consisting of a tubular grid connected to a high-voltage generator 10.

A heating element 11 emitting infra-red radiation is situated immediately downstream of the electrostatic dusting device 6.

The heating element 11 is immediately followed by an electrostatic flocking device 12. This device is of exactly the same construction as the dusting device 6 and also includes a holder 13 which contains cellulose fibers about 0.5 mm long, these fibers being entrained by a flow of compressed air from a source 14 blowing into the holder 13. This device also contains a cylindrical electrode 15, surrounding the wire 2, which is identical with electrode 9 and is connected to the same high-voltage generator 10. Electrode 15 may be mechanically linked with a vibrator, not shown, oscillating with a stroke amplitude smaller than the fiber length (e.g. 0.1 to 0.3 mm).

The flocking device 12 is followed by a cooling station 16, consisting of a channel 17 fed with cooling fluid from a liquid-air reservoir 18. The insulated wire is then wound on the take-up spool 3.

Preheating of the wire 2 by the device 4 is designed to bring the wire to a temperature causing local melting of the powder particles to be electrostatically deposited thereon. Satisfactory results will require the power of the heating system to be adjusted to the speed of forward travel of the copper wire 2. Use of a Joule-effect heating device has one considerable advantage with respect to the employment of other types of heaters, i.e. an inherent thermal inertia enabling it to be very finely regulated. It will be obvious that temperature regulation is a matter of importance. If the temperature is too low, insufficient adhesion of the powder particles will result; if it is too high, there will be a risk of damaging the copper wire.

The wire 2 is grounded via the conductor 5 so as to create an electrostatic field between it and the cylindrical grid 9 connected to the high-voltage generator 10. At the same time, polyethylene powder is carried by the flow of air through the powder holder 7. When this powder reaches the surface of the grid 9, the electrostatic field will give it a charge that will insure its being drawn to the wire and attached to the same by local melting as already described. The wire thus covered with powder is drawn through the infra-red heater or tunnel 11.

Figure 2:
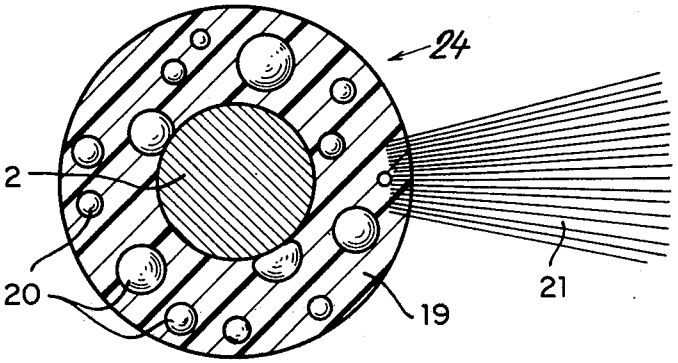
FIG. 2 is a cross-sectional view, drawn to a larger scale, of a conductor produced by the process shown in FIG. 1.

Heating in this tunnel is designed to melt the polyethylene particles clinging to the surface of the wire 2 so that they will form an insulating sheath around the same (FIG. 2). As can be seen in the latter Figure, this sheath is not uniform but has a cellular structure. Its cells 20 are full of air that has been trapped in the polyethylene mass during melting of the powder particles. When these particles are thrown onto the wire as a result of the electrostatic field set up inside the grid 9, they form a number of interstices therebetween irrespective of their shape. Once the powder is melted in the infra-red tunnel 11, the air that fills these interstices is trapped and forms the cells seen in FIG. 2.

By employing polyethylene as the insulating material, ohmic and dielectric losses can be kept down to a very low level. Moreover, the presence of air inside the polyethylene mass insures that the wire has a very low line capacitance, a factor whose importance in a conductor of a telecommunication cable has been discussed above.

The wire passes into the flocking device 12 while the insulating sheath 19 is still in the deformable state. Flocking is a process used primarily in the textile industry. It enables a previously glued surface to be covered with fibers whose length is about 0.5 to 1 mm. These are called flock and serve to give the surface a velvet appearance. Employment of an electrostatic field has the effect of arranging these fibers around the insulating sheath in a generally radial fashion. Since the sheath 19 is still penetrable, the cellulose fibers, when they are drawn into the electrostatic dusting device by means of the current of air passing through the fiber holder 13, are implanted in the sheath and thus form an insulated conductor 24 provided with a velvet-like coating 21 (FIG. 2).

Eventually, the wire passes through the cooling station 16 and is then wound up on the take-up spool 3.

As is well known, cellulose has the property of swelling on absorbing a certain quantity of water. As a result, the velvety area 21 formed of cellulose fibers serves the purpose of preventing the entry of water into the envelope of a telecommunication cable, as shown in FIGS. 5 – 7, in the event of breakage or deterioration of that envelope. In practice, since each of the insulating sheaths of the wires forming the cable is surrounded by an area composed of cellulose fibers, these fibers will swell in the event of water attempting to seep along the cable by capillary attraction, and the joint thus formed will be sufficiently tight to prevent the further spread of water. It is, in fact, extremely important to prevent the infiltration of water along the cable in the event of breakage or deterioration of its envelope, since serious damage will otherwise be caused.

The rate at which the insulated wire described here can be manufactured is at least twice as fast as that of making paper-insulated wire. The cost of the installation required for such manufacture is decidedly less than that of the extruders employed in the manufacture of insulating materials made of extruded plastic substances.

Figure 4:
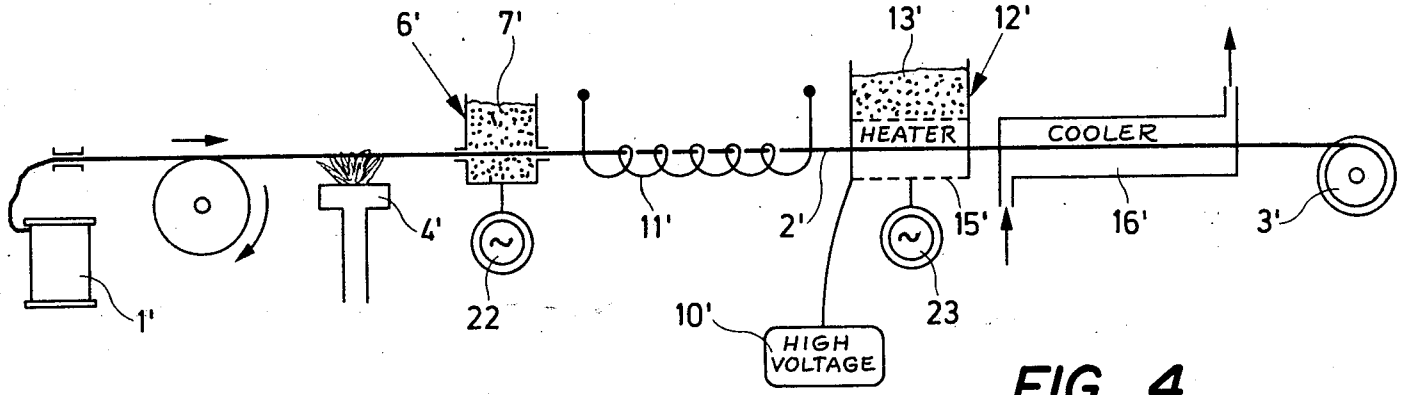
FIG. 4 is a diagram similar to that of FIG. 1, illustrating a modified plant for the production of such conductors.

FIG. 4 illustrates the set-up of an installation for carrying out a modification of the process described with reference to FIG. 1.

The installation of FIG. 4 includes a feed spool 1′, a take-up spool 3′ and a preheating device 4′. In this case, however, the preheater consists of a gas burner. The dusting device 6′ has a holder 7′ connected to a vibrator 22 which is energized with a mains frequency of 50 or 60 Hz. In the example here contemplated, the vibration amplitude is between 0.1 and 0.3 mm.

The main heating device 11′ consists of an electrical heating element, as in the system illustrated in FIG. 1. It is placed immediately before an electrostatic flocking device 12′ which includes a holder 13′ containing cellulose fibers about 0.5 mm. long. This holder 13′ is set above a cylindrical electrode 15′ formed partly of a grid connected to a high-voltage generator 10′ and partly of two semicylindrical castings on opposite sides of a plane containing the wire 2′. The holder 13′ is connected to a vibrator 23 which is also energized at a mains frequency of 50 or 60 Hz and, like vibrator 22, has an amplitude range of 0.1 to 0.3 mm.

The flocking device 12′ is once again followed by a cooling station 16′, this being the same as the cooling station 16 already described with reference to FIG. 1.

When the installation shown in FIG. 4 is set in operation, the wire is first heated by means of the burner 4′ to bring its temperature to a point where it will partially melt the powder that comes into contact therewith so that this powder will adhere to the wire. The vibrator 22 has the task of setting the mass of powder stored in the holder 7' in motion, so as to reduce the resistance offered to the passage of the wire into the holder and also to reduce the quantity of powder stripped off the wire before it exits from the holder. The advantage offered by this mode of coating the wire, as opposed to that described in connection with FIG. 1, mainly resides in the fact that the current of air used to bring the powder to the wire is dispensed with, this current tending to cool the wire and to reduce the amount of powder surrounding the same upon local melting.

Figure 3:
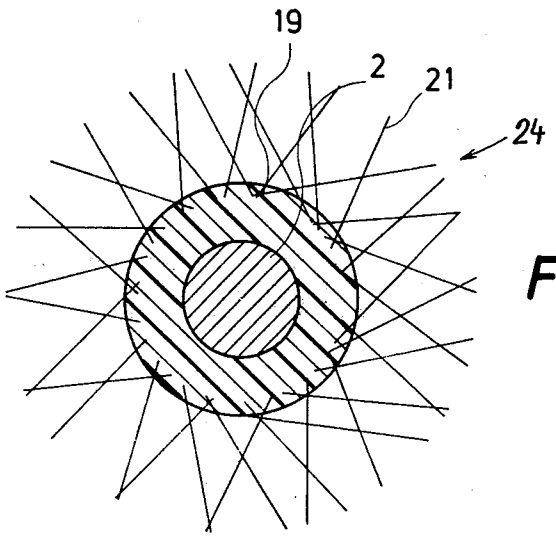
FIG. 3 is a view similar to FIG. 2, showing a modified conductor so produced.

The powder particles are then carried with the wire into the heating device 11' where they are melted to form a flowable plastic sheath around the copper wire. As a result of the fluidity of the plastic material employed, and the temperature to which it is heated, bubbles of air are trapped inside the material, as in FIG. 2; in some instances there may be no bubbles, as illustrated in FIG. 3. It should be noted that where a plastic material of the type shown in FIG. 2 is employed, that is to say a material that is inherently viscous or heated to a temperature close to its melting point, air is trapped in the sheath; this has the advantage of reducing the dielectric constant and the weight of the insulation. On the other hand, it will be clear that the cellulose particles have difficulty in penetrating such a viscous plastic material and sticking to it.

We therefore prefer to use a polyethylene that is relatively fluid when it is in the melted state. Because of this increased fluidity, the cellulose fibers will pass more readily into the plastic material during the electrostatic flocking operation. On the other hand, bubbles of air are no longer imprisoned in the sheath surrounding the copper wire.

This loss of air, however, is not of great importance since air will in any case be trapped between the wires when the telecommunication cable described hereinafter is assembled, thanks to the presence of cellulose fibers surrounding each wire used in the manufacture of the cable.

In the insulated conductor illustrated in FIG. 3, a high-pressure polyethylene powder obtained by means of distillation has been employed. This powder falls within the 20-to-200-micron grain-size class, its density is 0.915 g/cm$^3$, its melting point is 100°–103° C, and its melting index is 200 g/10 min.

After heating and coating with molten plastic material, the wire leaves the heating device 11' and immediately enters the electrostatic flocking device 12'. This device differs from the one shown at 12 in FIG. 1 by the fact that the fibers are no longer drawn into the electrical field of the electrode 15' by means of a current of air, but are gravity fed through the electrode by subjecting the holder 13' to vibration by means of the vibrator 23.

The use of the vibrator 23 enables the current of air to be dispensed with. The advantage of this feature lies in the fact that such current tends to cool the molten plastic and so to diminish its fluidity, as described above with reference to vibrator 22.

In FIG. 5 we have shown a twisted pair 25 of conductors 24 for a telephone cable according to our invention. Each conductor 24, formed in the manner hereinabove described, has the shape of a helix of constant pitch. The fibers 21 of the two conductors interpenetrate in the space between the two helices so as to act as spacers for their polyethylene sheaths 19. These sheaths, surrounding the copper cores 2 whose diameter may be approximately 0.6 mm, can have a thickness of about 0.2 mm with fibers measuring around 1 millimeter in average length and 25 denier in diameter. This composite insulation, when dry, has an elevated resistance and a low dielectric constant.

If the surrounding cable envelope (not shown in FIG. 5) is ruptured and water penetrates into its interior, the fibers have a dual function of impeding, by their swelling, the progression of the water along the cable axis and, through a lowering of their electric resistance, sharply increasing the leakage current and thus signaling the existence of a defect. The blocking of the flow by the swollen fibers is highly effective and limits the damage to a short length of cable. The location of the leak can be readily pinpointed by measurements of the current flow and the voltage drop along the line.

Even if the effective length of the projecting fibers varies somewhat about its mean value, the spacing of the conductor cores remains substantially unchanged during handling so that no significant variations in the shunt capacitance between the conductors occurs. Stabilization of that shunt capacitance at a predetermined magnitude is essential for the suppression of cross-talk between circuits of a quad including the conductor pair of FIG. 5, as more fully discussed hereinafter with reference to FIG. 8.

In a specific instance, cellulose fibers of the dimensions given above have a density on the order of 400 g/km.

The fact that the sheath is not extruded but is produced by the melting of polyethylene powder, as described above, also contributes to the maintenance of the desired symmetry inasmuch as any irregularities in the coating process tend to be randomly distributed around the conductor axis; on the other hand, any irregularity of an extrusion nozzle leads to a distinct eccentricity of the sheath. The interleaved fibers also resist any relative axial shifting of the conductors which in their absence could occur during handling, thereby unbalancing the circuit.

In FIG. 6 we have shown two balanced pairs 25 of the type illustrated in FIG. 5 within a common, flexible envelope illustrated diagrammatically at 26.

FIG. 7 shows a star quad 25' disposed within envelope 26; array 25' consists of four insulated conductors 24 twisted about a common axis, the conductor axes lying at the corners of a square in any transverse plane. In this instance the fibers interpenetrate not only in the spaces between adjoining conductors but also in a central channel 27 which would be completely empty in a quad composed of conventionally sheathed conductors including those with paper wrappings. While such wrappings could form a barrier between adjoining conductors, they would not swell sufficiently to block the flow of water in the vicinity of the cable axis. Envelope 26 may, of course, embrace a multiplicity of arrays 25 and/or 25'.

We shall now refer to FIG. 8 for a discussion of the part played by the various shunt capacitances in a quad forming three signaling circuits as noted above. In this Figure the four conductors have been designated *a*, *b*, *c* and *d*; the interconductor capacitances have been labeled $C_{ac}$, $C_{bc}$, $C_{ad}$ and $C_{bd}$; the shunt capacitances with references to ground are labeled $C_{ao}$, $C_{bo}$, $C_{co}$ and $C_{do}$. The first circuit consists of wires *a* (outgoing) and *b* (incoming), the second circuit consists of wires *c* (outgoing) and $d$ (incoming), and the third or phantom circuit consists of wires $a$, $b$ (outgoing) and $c$, $d$ (incoming). We can then define the cross-talk among these circuits in terms of three parameters, namely a factor $k_1$ relating to the first and second circuits, a factor $k_2$ relating to the first and third circuits and a factor $k_3$ relating to the second and third circuits. These parameters are given by the following equations:

$$k_1 = C_{ac} + C_{bd} - C_{bc} - C_{ad}$$

$$k_2 = C_{bc} + C_{bd} - C_{ac} - C_{ad} + \frac{C_{bo} - C_{ao}}{2}$$

$$k_3 = C_{ad} + C_{bd} - C_{ac} - C_{bc} + \frac{C_{do} - C_{co}}{2}$$

In the ideal case, $k_1 = k_2 = k_3 = 0$.

In practice, deviations from this ideal case are determined by the following parameters indicated in FIG. 9:

Dielectric constants $\epsilon_a$, $\epsilon_b$, $\epsilon_c$, $\epsilon_d$
wire radii $ra'$, $rb'$, $rc'$, $rd'$
outer radii of insulation $ra''$, $rb''$, $rc''$, $rd''$
eccentricities R$a$, R$b$, R$c$, R$d$ of wire axes
angular spacing $\alpha a$, $\alpha b$, $\alpha c$, $\alpha d$ of axial planes.

The conductor insulation according to our invention insures the essential constancy of the foregoing parameters over the entire length of the cable.

A cable according to our invention can be manufactured in a relatively simple manner and is lighter as well as more flexible than those of the paper-insulated type while being also considerably easier to splice with the aid of automatic equipment. The risk of unraveling, as with paper wrappings, is eliminated.

We claim:

1. A cable for an electric signaling system, comprising an envelope and a plurality of conductors disposed close to one another in said envelope, each conductor including a metallic core surrounded by a dielectric sheath and a multiplicity of nonconductive fibers partly embedded in said sheath and extending generally radially therefrom, the fibers of adjacent conductors interpenetrating in an intervening space and maintaining the relative position of said conductors in said envelope.

2. A cable as defined in claim 1 wherein said conductors form at least one twisted pair, said fibers consisting of a hydrophilic material and forming a mat resisting moisture penetration along said conductors in the event of a rupture of said envelope.

3. A cable as defined in claim 2 wherein said fibers are cellulosic.

4. A cable as defined in claim 3 wherein said fibers have a substantially uniform average length on the order of 1 mm and project from said sheath over the greater part of said length.

5. A cable as defined in claim 1 wherein said conductors form a twisted quad defining a central channel, said fibers consisting of a hydrophilic material and forming a mat in said channel resisting moisture penetration along said conductors in the event of rupture of said envelope.

6. A cable as defined in claim 1 wherein said sheath consists of polyethylene.

7. A conductor array for a cable of an electric signaling system, comprising at least one pair of conductors disposed close to one another in said envelope, each conductor including a metallic core surrounded by a dielectric sheath and a multiplicity of nonconductive fibers partly embedded in said sheath and extending generally radially therefrom, the fibers of adjacent conductors interpenetrating in an intervening space and maintaining the relative position of said conductors in said array.

8. An array as defined in claim 7 wherein the conductors of said pair are twisted together, said fibers consisting of a hydrophilic material and forming a mat resisting moisture penetration along said conductors.

9. An array as defined in claim 7 wherein said conductors form a twisted quad defining a central channel, said fibers consisting of a hydrophilic material and forming a mat in said channel resisting moisture penetration along said conductors.

* * * * *